US005360660A

United States Patent [19]

Nohlgren

[11] Patent Number: 5,360,660

[45] Date of Patent: Nov. 1, 1994

[54] FORMING FABRIC

[75] Inventor: Göran Nohlgren, Högsjö, Sweden

[73] Assignee: Scandiafelt AB, Hogsjo, Sweden

[21] Appl. No.: 108,637

[22] PCT Filed: Nov. 30, 1993

[86] PCT No.: PCT/SE92/00115

§ 371 Date: Aug. 25, 1993

§ 102(e) Date: Aug. 25, 1993

[87] PCT Pub. No.: WO92/15753

PCT Pub. Date: Sep. 17, 1992

[30] Foreign Application Priority Data

Feb. 28, 1991 [SE] Sweden ..... 9100577-7

[51] Int. Cl.[5] ..... D03D 3/00; D21F 1/10

[52] U.S. Cl. ..... 428/229; 162/348; 428/225; 428/257; 428/258; 428/259

[58] Field of Search ..... 428/225, 229, 257; 162/348, DIG. 1

[56] References Cited

U.S. PATENT DOCUMENTS 3,885,602 5/1975 Slaughter ..... 162/348

3,885,603 5/1975 Slaughter ..... 162/348

FOREIGN PATENT DOCUMENTS 0070708 1/1983 European Pat. Off. .

0144592 6/1985 European Pat. Off. .

*Primary Examiner*—James J. Bell

*Attorney, Agent, or Firm*—Jacobson, Price, Holman & Stern

[57] ABSTRACT

In a woven fabric fourdrinier forming belt (1) for a cellulose drying machine, the majority of the longitudinal wires in the weave are made from polyamide. To achieve that the finished belt has an elongation of at most 5% from loose, dry belt to tensioned wet belt, the longitudinal threads are made from a polyamide where the radio between the number of methylene groups and amide groups has a quotient of at least 7. The belt is round woven to a weaving pattern where the longitudinal threads (2) extend in two or more layers. In addition, the belt is stabilized by heating, pressing and stretching such as to obtain a ratio between knuckle height, measured on the inside of the threads, and total belt thickness has a quotient of at most 0.15 for all longitudinal threads (2).

The belt has good wear resistance and low extensibility, and is suitable for cellulose driers having limited streteching potential for the belt.

5 Claims, 1 Drawing Sheet

FORMING FABRIC

Figure 1A:
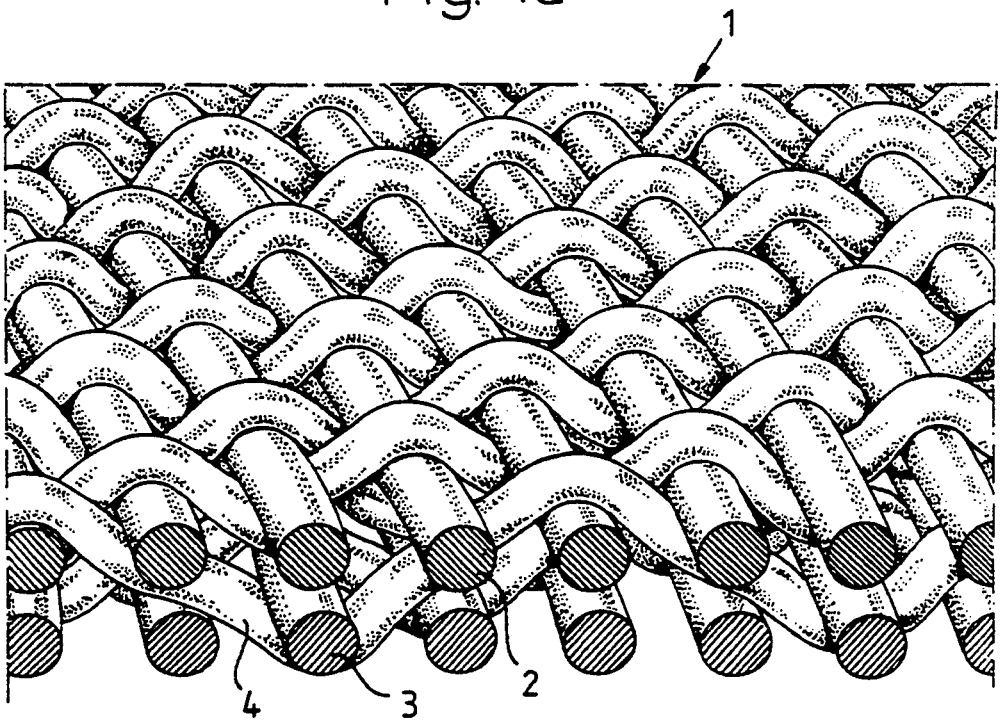

The present invention relates to a woven fabric fourdrinier forming belt, preferably for paper pulp or cellulose driers according to the preamble of claim 1.

Forming belts, as in fourdrinier machines, consist of an endless, continuously moving belt, and are intended to receive a fibrous slurry in a uniformly thick layer, where the major amount of water runs off through the belt, leaving the fiber layer on top of the fabric. The flat, upper part of the forming belt passes a plurality of suction boxes for improving dewatering, and possibly one or more press nips to obtain further dewatering. The lower part of the belt passes over a plurality of tensioning and guide rolls on its way back to the first roll. The belt is given a desired tension, which is typically 6–10 kN/m in today's machines, with the aid of the tensioning rolls. During operation, the belt is subjected to heavy wear, particularly during contact with the suction boxes, but also in passing rolls and press nips, as well as generally, due to pulsating tension. Wear also increases as a result of increased machine speed.

From originally being made as woven metal wire webs, forming belts were later made from synthetic material, particularly polyester, inter alia because of its good dimensional stability. However, polyester has poor wear resistance, inter alia due to fibrillation which led to belts made from this material having a relatively short life. In order to solve this problem to a certain extent, polyamide threads, being transversal to the moving direction of the fabric in the machine, have sometimes been woven into the fabric, thus somewhat improving resistance to wear of the belt.

Many modern cellulose driers are constructed such as to have good stretching potencial for the belt, which has meant that these machines can operate without problems where change in belt length is great in the comparison between a loose, dry belt and the same belt when tensioned and wet. This has resulted in the utilisation of belts made entirely from polyamide PA6, which is preferable from general technical and economic aspects, although the change in length for the conditions just mentioned is about 6–9%. Belts from this material are very durable, but compared with belts having polyester threads in the direction of belt travel they have instead much poorer dimensional stability.

In contradiction to modern cellulose driers, the forming belts of older ones of this kind have been afforded very small potential for stretching, and such belts made from polyamide 6, with their obvious advantages, have not been able to be used in these machines without expensive alterations.

It is therefore an object of the present invention to achieve a woven fabric forming belt, made to a major extent from some polyamide material that utilises the good properties residing in this group of material, while the finished product has an elongation of at most about 5% from loose dry belt to tensioned belt in the wet state.

This object is attained by a woven fabric forming belt that has been given the distinguishing features disclosed in the characterising portion of claim 1. Accordingly, even older machines may be equipped wich forming belts made from a material that is very durable, permits considerably longer operation times between belt replacements, permits higher machine speeds and leads on the whole to more effective production with the machines. Since the thread material is selected from polyamides where the ratio between methylene groups and amide groups has a quotient of at least 7, good fabric stability and low moisture absorption ability are obtained. In addition, if the fabric is round-woven, i.e. its longitudinal threads in the belt are weftwise in the weaving machine, such that there is a weaving pattern where the longitudinal threads extend in separate layers of two or more, and the belt fabric is rendered stable by heating, pressing and stretching so that the relationship between knuckle height measured on the inside of the thread and total fabric thickness givs a quotient of at most 0,15 for all longitudinal threads, there is surprisingly enough achieved a forming belt of polyamide with an elongation of at most about 5% during the belt operation time in the most difficult applications, this belt thus being very suitable in cellulose driers with limited stretching potential for the forming belt.

Further advantages are afforded by the distinguishing features disclosed in the dependent claims.

Figure 1B:
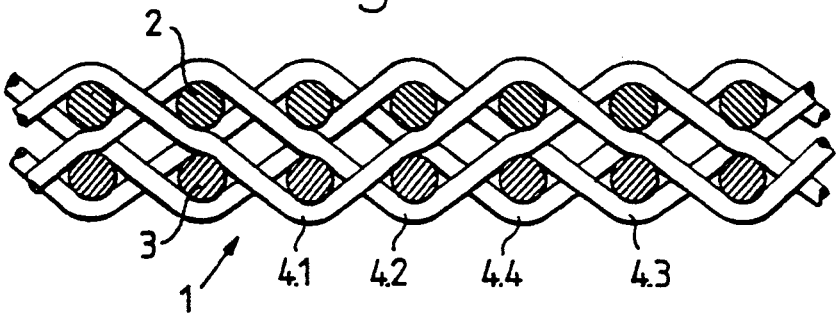
Figure 2:
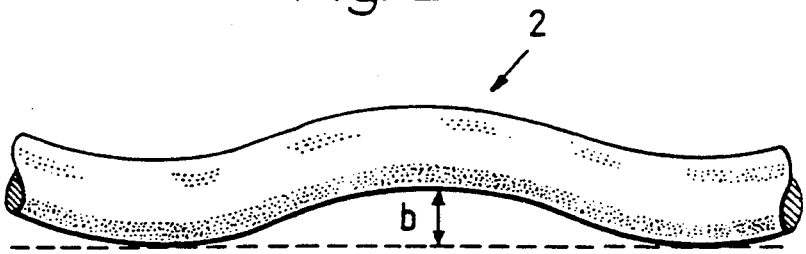

The invention will now be described with reference to an embodiment and to the accompanying drawing, where FIG. 1*a* is a photograph of a detail of a woven fabric fourdrinier forming belt in approximately 21× magnification, and FIG. 1*b* is a cross section through an inventive forming belt FIG. 2 illustrates an uncovered longitudinal thread in an inventive forming belt.

FIG. 1*a* thus illustrates a detail of a finished forming belt 1 in section, with longitudinal threads 2 and 3 extending in the travelling direction of the belt and in two separate layers. These threads are weftwise in the weaving machine when the belt is round-woven. One of the transverse threads in the belt is denoted by the numeral, these threads being warpwise in the weaving machine.

In FIG. 1*b* there is shown a cross section through a belt 1 with longitudinal threads 2 and 3 in two separate layers. The transverse threads comprise 1st, 2nd, 3rd and 4th transverse threads 4.1–4.4 extending from the underside of the belt between two longitudinal threads 2–3, to its upper side and back again to the underside in the same way. The four threads in the pattern form a twill weave excepting that the third and fourth are reversed (so called cross twill).

When the belt is ready-woven it forms a round weave, possibly with a woven-in openable joint or seam, for facilitating installation in the machines. After the weaving operation, the belt is stabilished by heating, pressing and stretching, primarily to achieve stability in its travelling direction in the drier.

In FIG. 2 there is illustrated an isolated longitudinal thread 2, as it extends in a finished belt according to the invention. This thread has a knuckle with a height b to the inside thereof, and in the inventive belt, the ratio between b and the total thickness t of the belt shall be less than 0.15.

The invention is also applicable to such as weaves having longitudinal threads in more than two layers. With three layers of longitudinal threads and otherwise corresponding weaving technique and stabilising procedure as in the described embodiment example, there is obtained a value for b/t of 0.07–0.10.

In a comparative test, an inventive belt with threads of polyamide 610 in the weave has been compared with a belt produced in the same way, but where the threads material was polyamide 6. Polyamide 610 has a methylene group/amide group number ratio with a quotient of 7, and is a polyamide that has been found to be very suitable in a belt in accordance with the invention. In this test the finished belts in a wet state have been subjected to a cyclic load of 8–15 kN/m belt width during one hour, while elongation measurements were taken. In addition, threads of polyamide 6 and 610 have been subjected to individual cyclic loading in a wet state, where the loading corresponds to the stress the respective longitudinal threads carries in a finished belt. The tests simulate in a realistic manner the severest belt positions in a cellulose drier.

Test Results

For a thread of polyamide 6 there is an elongation of 5.5%, and for a belt of this material an elongation of 8.7%. For a thread of polyamide 610 there is an elongation of 3%, and for a belt of this material an elongation of 4.7%.

It has thus been found that a belt of polyamide 6 stretches about 3.2% more than a thread of the same material, whereas a belt of polyamide 610 n accordance with the invention merely stretches about 1.7% more than a thread of the same material. These results confirm that the good properties of the belt in accordance with the invention, and its practical use in machines having a small stretching possibilities for the belt depend on a combination of its physical implementation and the material selected for it.

The embodiment example accounted for above, should be regarded as a variant of the invention, which is solely restricted by the definition thereof in the accompanying claims. Accordingly, weave patterns other than the one exemplified here may be envisaged. In addition, the weave may contain a limited number of threads made from materials other than the mentioned polyamide material, should this be desirable for some reason.

I claim:

1. Woven fabric fourdrinier forming belt preferably for cellulose drying machines and having a majority of polyamide threads in the weave, characterized in that the longitudinal polyamide threads are made from a polyamide where the ratio between the number of methylene groups and amide groups is at least 7;

the belt is round woven, i.e. its longitudinal threads are weftwise in the weaving machine, and has a weaving pattern where the longitudinal threads extend in two or more layers; and in that the belt is stabilized by heating, pressing and stretching such that the ratio between the knuckle height b measured on the inside of the knuckle, and the total belt thickness t, is less than 0.15 for all longitudinal threads.

2. Belt as claimed in claim 1, characterized in that the longitudinal threads extend in three layers, and in that b/t is at most 0.10.

3. Belt as claimed in claim 1, characterized in that polyamide 610 is used in the majority of the longitudinal threads in the weave.

4. Belt as claimed in claim 1, characterized in that polyamide 610 is used in some of the transverse threads in the weave.

5. Belt as claimed in claim 1, characterized in that it has a woven seam.

* * * * *